US005352015A

United States Patent [19]

Morgan

[11] Patent Number: 5,352,015

[45] Date of Patent: Oct. 4, 1994

[54] DEMOUNTABLE TABLE AND SEAT STRUCTURE

[76] Inventor: Michael C. Morgan, 6 S. 130 Country Dr., Naperville, Ill. 60540

[21] Appl. No.: 870,332

[22] Filed: Apr. 17, 1992

[51] Int. Cl.[5] ..... A47B 83/02

[52] U.S. Cl. ..... 297/157; 297/440.24; 297/188

[58] Field of Search ..... 297/45, 126, 127, 135, 297/139, 157, 159, 170–172, 174, 438, 441, 188; 108/25, 92, 101

[56] References Cited

U.S. PATENT DOCUMENTS

| | | | |
|---|---|---|---|
| D. 145,779 | 10/1946 | Davis | 297/172 X |
| 1,252,133 | 1/1918 | Martin | 297/174 |
| 2,362,567 | 11/1944 | LaRue . | |
| 2,664,148 | 12/1953 | Rechler | 297/438 |
| 3,227,111 | 1/1966 | Rainwater | 108/129 |
| 4,040,658 | 8/1977 | Mayol | 297/159 |
| 4,122,780 | 10/1978 | Brickman | 108/25 |
| 4,177,737 | 12/1979 | Brickman | 108/11 |
| 4,415,199 | 11/1983 | Wright | 297/159 |
| 4,603,642 | 8/1986 | Brickman | 108/25 |
| 4,607,880 | 8/1986 | Gastebled | 297/157 |
| 4,625,655 | 12/1986 | Brickman | 108/25 |
| 5,046,206 | 9/1991 | Broyles | 5/432 |

FOREIGN PATENT DOCUMENTS

| | | | |
|---|---|---|---|
| 988168 | 8/1951 | France | 297/139 |
| 662 | of 1885 | United Kingdom | 297/174 |

*Primary Examiner*—Peter R. Brown
*Attorney, Agent, or Firm*—Charles A. Johnson

[57] ABSTRACT

A demountable table and seat assembly having a fabric table top and associated fabric seats is described. The assembly includes tubular structures that are slidably engaged to hold the fabric table top and the associated fabric seats in tension and thereby capable of supporting weight. Container receiving apertures are formed in the table top, and have associated container receptacles for supporting associated containers. Fabric tension members are shown for providing lateral stability for the entire table and seat assembly.

13 Claims, 2 Drawing Sheets

DEMOUNTABLE TABLE AND SEAT STRUCTURE

BACKGROUND OF THE INVENTION

1. Field of the Invention.

The invention relates to an improved demountable table and seat structure, and more particularly to a structure that utilizes a fabric table top and associated fabric seats.

2. State of the Prior Art.

It is well-known to boaters, campers, hikers, packers, and family picnicers, that it is desirable to have a table and seats available, but generally a table and seats are not readily available due to weight and cumbersome structure limitations on portability. It is also desirable to have a table and seat structure that is durable and strong, while being easily demountable and structured for packing into a lightweight and compact arrangement that can be easily packed in a boat or camper, carried on a backpack, packed on pack animals, and easily stored. While many types of folding and collapsible table structures are known in the prior art, none of them are sufficiently demountable and light weight to allow convenient use by picnicers, boaters, campers, and packers.

There are various categories of folding tables shown in the prior art. Some of these folding tables have folding seats associated with them. One group of prior art tables have the common problem that the table itself is constructed of solid materials such as wood boards and the like. This group of tables is primarily limited to home use, and cannot be readily moved about due to weight and structural rigidity. Clearly, this group of structures is not adapted for packing, camping, or boating.

Some examples of this first group of table structures are shown in U.S. Pat. No. 4,607,880 to Gastebled, which shows a folding tubular structure that is slidably coupled to and used to support a solid table top along with a pair of solid bench seats; U.S. Pat. No. 2,362,567 to LaRue, which shows a pipe structure that is screwed together for supporting a solid table top and two solid bench seats, or alternatively for supporting a solid flat surface that can be used as a bed, all with an optional canopy; U.S. Pat. No. 4,040,658 to Mayol, which shows a folding picnic table on wheels and adapted for the pair of solid bench seats to fold inwardly: U.S. Pat. No. 4,415,100 to Wright, which shows a heavy-duty folding table; and U.S. Pat. No. 5,046,206 to Broyle, which shows a combined bed chair, tray and footrest that is made from tubular sections, but is not easily demountable or easily transported.

There is a second group of prior art that illustrates various forms of foldable fabric table structures that are generally small in size and are adapted for special purposes, but do not provide any associated seating.

Some examples of this second group are U.S. Pat. Nos. 4,122,780; 4,177,737; 4,625,655; and 4,603,642, all issued to Brickman, all of which show various bar table structures using a pivoted cross-leg frame having a fabric top and illustrating various storage capabilities. Tables in this group tend to sway, and are not known to be sturdy due to the pivoted cross-leg structure.

U.S. Pat. No. 3,227,111 to Rainwater shows a foldable tubular structure having fabric mounted thereon that can be erected into a structure.

OBJECTS

It is a primary object of the invention to provide an improved demountable table and seat assembly.

Another primary objective of the invention is to provide an improved demountable table and seat assembly that utilizes a fabric table top and associated fabric seats.

Yet another objective is to provide a structure for a demountable table and seat assembly having a fabric table top and fabric seats that is sturdy when assembled.

Another object of the invention is to provide an improved table and seat assembly wherein a fabric table top is held in tension in a first direction and one or more associated fabric seats are held in tension in a second direction transverse to the table top.

Still another object of the invention is to provide a demountable table and seat assembly that may be easily disassembled for packing or cleaning.

A further objective is to provide an improved demountable table and seat assembly having a frame structure that is not subject to rust or corrosion, and a fabric table top and seats that may be washed and easily replaced if damaged.

Yet another objective is to provide an improved demountable table and seat assembly that can be easily disassembled and can be compactly arranged for packing by boaters, hikers, and packers.

Another object of the invention is to provide an improved demountable table and seat assembly that is stable with or without users sitting on the seats.

A further objective is to provide a fabric table top having container retaining structures for use in an improved demountable table and seat assembly.

Yet another objective is to provide a tubular frame structure having joints slidably engaged for use in a demountable table and seat assembly.

SUMMARY OF THE INVENTION

Other more detailed and specific objectives will become apparent from the drawings and the following description of the invention. To accomplish the purposes and objectives of the invention a plurality of seat support structures are utilized. Each seat support structure has a seat support member for supporting an associated fabric seat, an upright table top support member for supporting a table top assembly, and a coupling structure for slidably engaging an associated seat spreader for holding the seat fabric in tension along its length. A fabric table top is mounted to side support members along each of its sides. A pair of table top end members and at least one intermediate table top member define the width of the table top, and are slidably supported on associated ones of the upright table top support members. These table top width defining members include coupling devices for slidably receiving associated ones of the side support members, and when assembles form a rigid frame for the table top, and functions to hold the fabric table top in tension across its width.

DETAILED DESCRIPTION OF THE INVENTION

Figure 1:
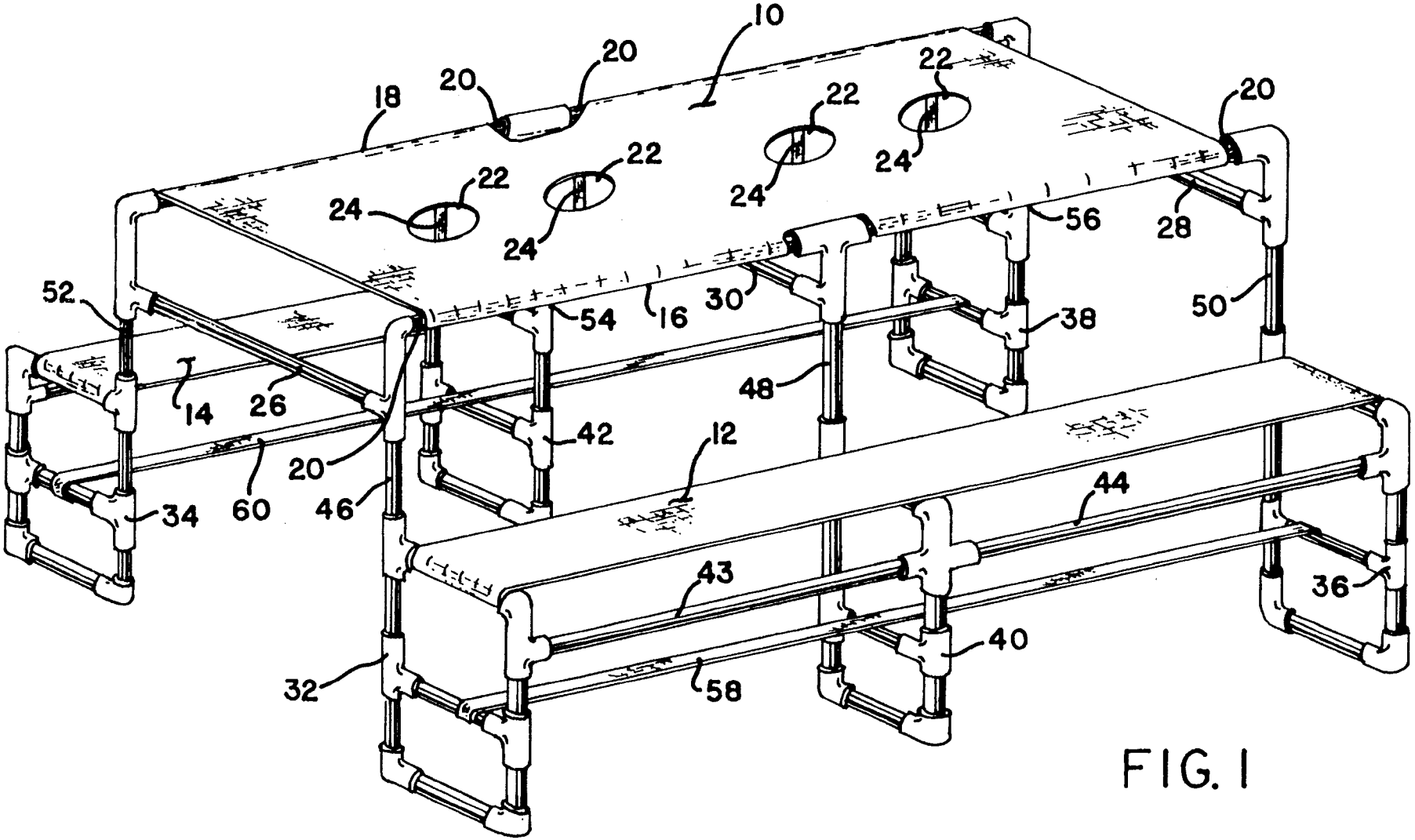
FIG. 1 perspective view of the improved demountable table and seat assembly having a fabric table top and associated fabric seats.

FIG. 1 is a perspective view of an improved demountable table and seat assembly having a fabric top 10 and associated fabric seats 12 and 14. The fabric table top 10 is affixed along its sides 16 and 18 to side support members 20, each of which are tubular and of a length to support substantially the entire length of fabric top 10 along each of its sides 16 and 18. The preferred arrangement is to turn back the edges at sides 16 and 18, and sew the edges to the table top fabric, thereby forming a substantially continuous closed loop that can receive the associated support members 20 inserted along their length. It is of course understood that other forms of fastening, such as snaps, zippers, velcroe, adhesives, or the like could be used in place of sewing. The fabric can be canvass or any other flexible material that would have characteristics suitable for specific uses. The main characteristics are relative stability under various atmospheric and use condition, resistance to decay or damage from use and the elements, and sufficient structural strength to substantially retain its shape in a plane when under tension and when loaded.

Since the fabric table top 10 is not entirely rigid, containers other than plates, saucers and bowls may tend to tip when the fabric is subjected to various pressures by users. To alleviate this potential problem, container receiving apertures 22, of the same or various dimensions, are arranged in a desired pattern to allow access by users. At the underside of top 10, container receptacles 24 are affixed in cooperation with associated ones of the container receiving apertures 22, and function to support containers deposited therein. These structures will be described in more detail below.

A pair of table top end members 26 and 28, and an intermediate table top member 30 define the width of the table top assembly, and in conjunction with the plurality of associated support members 20 form a rigid table top support structure and hold the fabric table top 10 in tension across its width. A detailed description of the table top end members 26 and 28 will be set forth below.

A pair of end seat support structures 32 and 34 and a second pair of seat support structures 36 and 38 at the opposite end of the assembly, along with intermediate seat support structures 40 and 42, are arranged such that seat support structures 32, 40, and 36 support fabric seat 12, and seat support structures 34, 42, and 38 support fabric seat 14. Seat spreader 43 is slidably engaged between seat support structures 32 and 40, and seat spreader 44 is slidably engaged between seat support structures 40 and 36. Seat spreader 42 and 44 are of a length to hold fabric seat 12 in tension along its length. In a similar manner seat spreaders (not shown) cooperate between seat support members 34 and 42, and 42 and 38 to support fabric seat 14 and to hold it in tension.

Fabric seats 12 and 14 each have end portions folded back and affixed to form closed loops at each end that can receive the associated portion of the end seat support structures 32, 34, 36, and 38. As with the fabric table top 10, fabric seats could have other forms of attachment, and the fabric can be canvass or such other fabrics having characteristics for the selected usage.

The upright-table support members 46, 48, 50, 52, 54, and 56 of the associated seat support members cooperate with the pair of table top end members 26 and 28 and intermediate table top member 30 to support the table top support structure. The seat support structures will be described in more detail below.

Fabric tension member 58 is coupled between end seat support structures 32 and 36, and fabric tension member 60 is coupled between end seat support structures 34 and 38. Tension members 58 and 60 function to assist in holding fabric seats 12 and 14, respectively, in position and under longitudinal tension.

Figure 2:
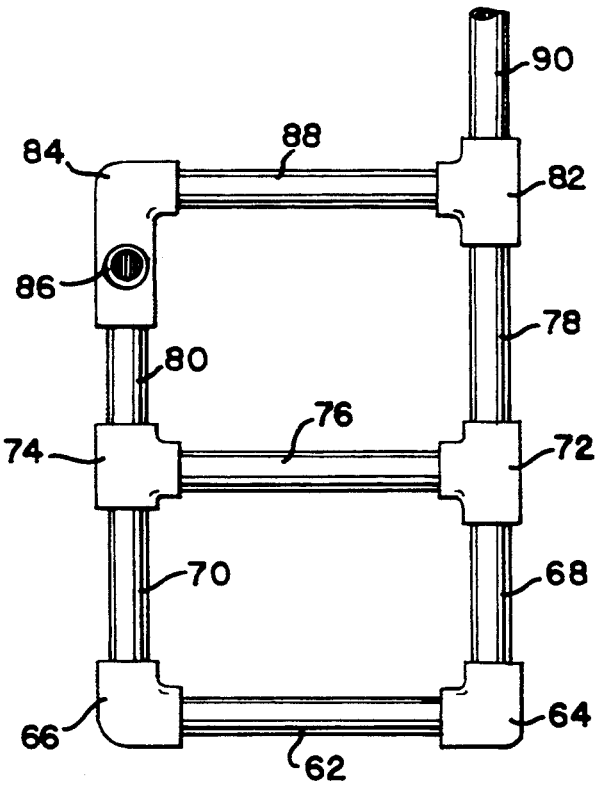
FIG. 2 is a side view of a seat support structure.

FIG. 2 is a side view of a seat support structure. One seat support structure will be described, it being understood that the pairs of structures 32 and 34 will be the mirror image of structures 36 and 38. In the preferred embodiment the various straight sections are tubular and generally circular in cross-section. The elbows and T-sections are generally of a dimension that will accommodate a slidable engagement with the straight sections. Portions of the structures are preferably fastened in place, while other portions are slidably engaged, and are not intended to be permanently fixed, thereby allowing demounting when the structure is to be disassembled or demounted.

The seat support structure has a surface engaging member 62 mounted in elbows 64 and 66. Upward extending members 68 and 70 are fitted in elbows 64 and 66, respectively, and at their other ends are fitted in T-members 72 and 74, respectively. A cross-member 76 is fitted at its ends into T-members 72 and 74, and used to affix the associated tension strap, or at the intermediate location to support it. A second pair of upright members 78 and 80 have their lower ends inserted in T-sections 72 and 74, respectively, and have their upper ends inserted in T-section 82 and elbow 84, respectively. A third cross-member 88 has its ends inserted in T-section 82 and elbow 84, and functions as the seat support portion of the assembly. Elbow 84 has an associated coupling 86 extending at right angles to the assembly. This coupling 86 is utilized to slidably engage an associated end of a seat spreader. It is of course understood that an intermediate seat support structure would have another similar coupling at right angles on the opposite side. Upright member 90 is utilized to slidably engage a coupling (to be described in more detail below) associated with either a table top end member 26 or 28, or an intermediate table top member 30.

The seat support structures can be constructed plastic pipe that is not subject to corrosion or rust, and can be easily assembled and affixed by well-known adhesive methods. Other materials such as aluminum or other light weight materials could also be used, it being understood that materials of sufficient strength must be selected.

Figure 3:
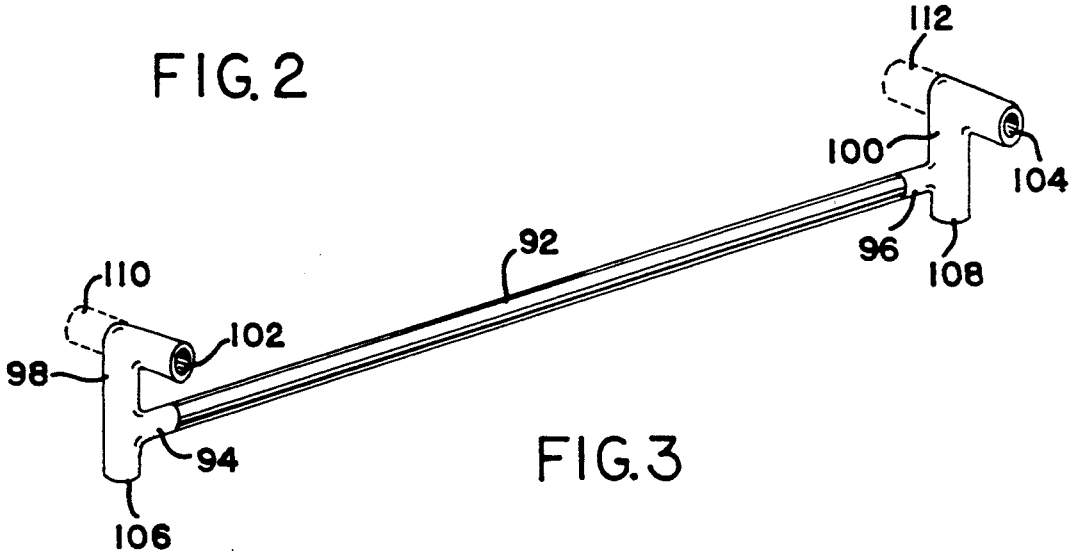
FIG. 3 is a perspective view of table top end members.

FIG. 3 is a perspective view of table top end members 26 and 28. This structure has a width portion 92 having its ends affixed to couplings 94 and 96 at right angles to elbows 98 and 100, respectively, and is utilized to define the width of the table top. Elbows 98 and 100 have slidable coupling portions 102 and 104, respectively, for slidably engaging associated ends of support members 20. The table top members are adapted to utilize coupling portions 106 and 108, which are downwardly extending, to slidably couple to upwardly extending section 90 of the seat support structures. It is of course understood that intermediate table top member 30 would be similarly constructed, except elbows 98 and 100 would be Y-sections, as illustrated by dashed extensions 110 and 112.

Figure 4:
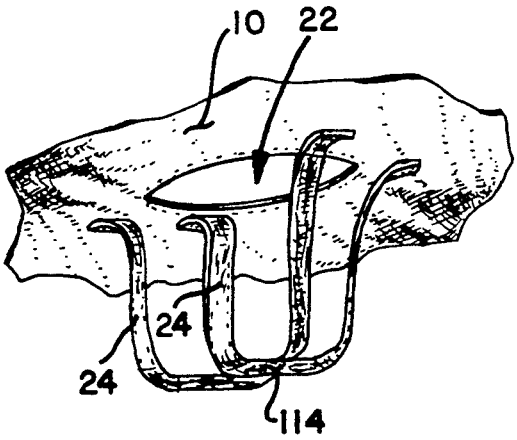
FIG. 4 is a view of a container receptacle mounted to the underside of the fabric table top in cooperative relationship with a container receiving aperture.

FIG. 4 is a view of a container receptacle mounted to the underside of the fabric table top 10 in cooperative relationship with a container receiving aperture 22. Strips of fabric 24 are formed into a U-shaped configuration joined at the center 114, and having the ends affixed to the underside of the table top fabric. The length of the strips and their positioning with respect to aperture 22 will depend on the shape and nature of the container to be supported. In this configuration two U-shaped strips are utilized, but it is contemplated that more such strips could be utilized to support larger diameter or heavier containers. It is also contemplated that the circumference of the aperture 22 will be reinforced, as by providing rolled and affixed table top material, or by adding specific reinforcing material.

For those couplings that are specified as being slidably engaged, it is contemplated that auxiliary fastening structures may used to aid in the stability of the table and seat assembly, and to forestall any inadvertent disconnection when the assembly is being moved about. The manner of making any such fixed coupling will be such that the couplings can be disconnected to allow the structure to be demounted. One form of interconnection is to place aligned holes through the couplings and to utilize bolts and nuts (not shown). Another form of interconnection is a spring loaded detent operated through detent holes in the outer coupling structure, thereby allowing disconnection by depressing the detent and sliding the coupling apart (not shown). Other forms of locking-unlocking mechanisms can be utilized.

The preferred embodiment has been illustrated with a pair of table top end members 26 and 28, and one intermediate table top member 30. It is contemplated that additional intermediate table top members can be utilized to thereby extend the length of the table, while providing sufficient strength to the structure.

Having described a preferred embodiment of the invention in conjunction with the drawings, it can be seen that the various stated purposes and objective have been obtained, and that various modifications and extensions will become apparent to those skilled in the art within the spirit and scope of the invention. Accordingly, what is intended to be protected by Letters Patent is set forth in the appended claims.

I claim:

1. A demountable table and seat assembly comprising:

a plurality of seats support structures, each having a table top supporting structure and at least one seat spreader engaging coupling;

a plurality of removable seat spreader members, each having coupling ends with each of said ends for removably engaging an associated one of said seat spreader engaging couplings, said plurality of removable seat spreader members holding said plurality of seat support structures spaced apart;

a table top assembly having a plurality of coupling devices slidably removably engaging associated ones of said table top supporting structures;

at least one fabric seat mounted to associated ones of said seat support structures and held in tension in a first direction; and a fabric table top having predetermined length dimensions and width dimensions and mounted to said table top assembly and held in tension in a second direction substantially transverse to said first direction, whereby said plurality of seat support structures and said table top assembly are at least partially held in place by and provide said tension in said first direction and said second direction by said at least one fabric seat and said fabric table top.

2. A demountable table and seat assembly as in claim 1, and further including fabric brace members coupled in tension between selected ones of said plurality of seat supports.

3. A demountable table and seat assembly as in claim 1, wherein said fabric table top includes closed loops formed along at least portions of said length dimensions.

4. A demountable table and seat assembly as in claim 3, wherein said table top assembly includes a pair of table top end members, each having a predetermined table top width defining length and table top spreader coupling devices at each end thereof; and a plurality of table top spreader members, each having a predetermined length and first and second ends, and in cooperation with an associated one of said closed loops in said fabric table top; and each of said first and second ends in slidable engagement with associated ones of said table top spreader coupling devices.

5. A demountable table and seat assembly as in claim 4, and further including at least one intermediate table top member having said predetermined table top width defining length and a pair of table top spreader coupling devices at each end thereof.

6. A demountable table and seat assembly as in claim 3, wherein said fabric table top has a predetermined number of container receiving apertures formed therein: and further includes a like plurality of container support structures, each mounted to the underside of said fabric table top and in cooperative relationship with an associated one of said container receiving apertures.

7. A demountable table and seat assembly as in claim 1, wherein each of said plurality of seat supports includes, a surface engaging member;

a pair of upright seat-height defining members coupled to said surface engaging member, one of said pair coupled to said table top supporting structure;

a fabric seat supporting member coupled intermediate said pair of upright seat-height defining members;

a cross-brace member; and at least one seat spreader coupling device adapted for slidable engagement with an end of an associated one of said plurality of removable seat spreader members.

8. A demountable table and seat assembly as in claim 7, and further including a fabric brace member coupled between associated pairs of said cross-brace members.

9. A demountable table and seat assembly as in claim 1, wherein said plurality of removable spreader members, said plurality of seat support structures and said table top assembly are constructed of tubular members having a first predetermined outer cross-section shape and dimension, and said coupling devices have a second predetermined inner cross-section shape and dimension sufficiently larger than said first predetermined outer cross-section dimension to accommodate slidable cooperation therebetween.

10. A demountable table and seat assembly comprising:

table fabric means for use as a table top;

seat fabric means for use as seats;

table top frame means for supporting said table fabric means and for holding said table fabric means in tension in a first direction, said table top frame means having two end members, each including demountable table top coupling means; and seat support means for supporting said seat fabric means for holding said seat fabric means in tension in a second direction said first direction, said seat support means including top support means for removably engaging associated ones of said demountable table top coupling means for coupling said table top frame means to said seat support means and for supporting said table top frame means at least at said two end members;

wherein said table fabric means includes loop means for slidably engaging portions of said table top frame means; and wherein said table top frame means includes a plurality of cross-member means each having spreader coupling means at each end thereof;

a plurality of table top spreader means, each having a predetermined length and arranged for slidably cooperating with an associated one of said loop means and first and second ends for slidably cooperating with associated ones of said spreader coupling means; and support coupling means for mounting to said seat support means.

11. A demountable table and seat assembly as in claim 10, and further including tension brace fabric means coupled between associated ones of said seat support means for preventing dislocation of said seat support means.

12. A demountable table and seat assembly as in claim 10, wherein said table fabric means includes container receiving apertures formed therein and further includes container support means in cooperation with said apertures for supporting containers.

13. A demountable table and seat assembly comprising:

table fabric means for use as a table top;

seat fabric means for use as seats;

table top frame means for supporting said table fabric means and for holding said table fabric means in tension in a first direction, said table top frame means having two end members each including demountable table top coupling means; and seat support means for supporting said seat fabric means for holding said seat fabric means in tension in a second direction from said first direction, said seat support means including top support means for removably engaging associated ones of said demountable table top coupling means for coupling said table top frame means to said seat support means and for supporting said table top frame means at least at said two end members;

wherein said seat support means includes a plurality of seat spreader means for holding said seat fabric means in tension; and a plurality of seat support assembly means, each including surface engaging means for resting on a support surface;

upright seat-height defining means coupled to said surface engaging means for defining seat height;

seat supporting means for supporting at least a portion of said seat fabric means;

cross-brace means for bracing and providing structural rigidity;

top support coupling means for slidably engaging associated ones of said top coupling means; and spreader coupling means for slidably coupling to associated ones of said plurality of seat spreader means.

* * * * *